US010183501B2

(12) United States Patent
Kubota

(10) Patent No.: US 10,183,501 B2
(45) Date of Patent: Jan. 22, 2019

(54) PRINT MEDIUM, PRINTING DEVICE, AND PRINTING METHOD FOR PRINTING DEVICE

(71) Applicant: Seiko Epson Corporation, Tokyo (JP)

(72) Inventor: Tomoyuki Kubota, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 798 days.

(21) Appl. No.: 14/665,030

(22) Filed: Mar. 23, 2015

(65) Prior Publication Data

US 2015/0273865 A1 Oct. 1, 2015

(30) Foreign Application Priority Data

Mar. 25, 2014 (JP) ..... 2014-062316

(51) Int. Cl.
*G09F 3/02* (2006.01)
*B41J 3/407* (2006.01)

(52) U.S. Cl.
CPC ..... *B41J 3/4075* (2013.01); *G09F 3/02* (2013.01); *G09F 2003/0202* (2013.01)

(58) Field of Classification Search
CPC .... B41J 3/4075; G09F 3/02; G09F 2003/0202
USPC ..... 281/5, 12; 283/67, 70, 81
See application file for complete search history.

(56) References Cited

U.S. PATENT DOCUMENTS 5,230,938 A * 7/1993 Hess ..... G09F 3/02 283/79
2003/0053014 A1* 3/2003 Niiyama ..... G02F 1/13473 349/106
2008/0212165 A1* 9/2008 Jagt ..... G02F 1/134327 359/296
2013/0128316 A1 5/2013 Kurashina
2014/0226170 A1* 8/2014 Ishii ..... B41J 3/4075 358/1.12

FOREIGN PATENT DOCUMENTS

EP 1484734 A2 * 12/2004 ..... G09F 3/202
JP 2009-217662 A 9/2009

* cited by examiner

*Primary Examiner* — Justin V Lewis
(74) *Attorney, Agent, or Firm* — ALG Intellectual Property, LLC

(57) ABSTRACT

A print medium, on which individual labeling information made up of one or more labeling elements that are selectively shown, of common labeling information made up of a plurality of labeling elements, is formed by a printing device, wherein the common labeling information is printed in advance and a background color of an area where at least a plurality of labeling elements is printed is a print color that is printable by the printing device, is disclosed.

18 Claims, 5 Drawing Sheets

PRINT MEDIUM, PRINTING DEVICE, AND PRINTING METHOD FOR PRINTING DEVICE

CROSS-REFERENCE TO RELATED APPLICATION

The entire disclosure of Japanese Patent Application No. 2014-062316, filed Mar. 25, 2014 is expressly incorporated by reference herein.

BACKGROUND

1. Technical Field

The present invention relates to a print medium on which labeling information such as a letter string is formed by a printing device, a printing device, and a printing method for a printing device.

2. Related Art

According to the related art, a printing device (tape printing device) having a tape cartridge which accommodates a print tape, a cartridge loading section in which the tape cartridge is loaded, a platen drive shaft which fits with a platen roller, a tape feeding motor which rotates the platen drive shaft to reel off the print tape from the tape cartridge, a print head which carries out printing on the print tape that is reeled off, and a CPU which controls the tape feeding motor and the print head, is known (see JP-A-2009-217662). This printing device is configured to be able to prepare a label to be pasted on a cable, cord or the like. On this label, labeling information such as date and identification number is formed.

With respect to labels of this type, there is a demand that the color of the labeling information should be changeable according to need, in order to enhance identifiability of the labeling information. For example, in preparing a label to be pasted on an electric wire or the like, in some cases, a plurality of pieces of labeling information is formed on a single label. In such cases, it is demanded that color should be changed from one piece of labeling information to another, so that the types of the plurality of pieces of labeling information that is formed (what each piece of labeling information expresses) can be identified.

However, in the related-art printing device, since the color of the labeling information depends on the print color of the printing device (color that is printable by the printing device, for example, black), the ink ribbon (color ribbon) or the like needs to be replaced to change the print color of the printing device in order to change the color of the labeling information. Therefore, there is a problem that changing the color of the labeling information is very troublesome. To cope with this, it is possible to configure the printing device in such a way as to be able to print in a plurality of colors. However, in this case, the configuration of the printing device is complex, or consumables used (ink ribbon and the like) are expensive.

SUMMARY

An advantage of some aspects of the invention is to provide a print medium, a printing device, and a printing method for a printing device in which the color of the labeling information can be changed without changing the print color of the printing device.

An aspect of the invention is directed to a print medium on which individual labeling information made up of one or more labeling elements that are selectively shown, of common labeling information made up of a plurality of labeling elements, is formed by a printing device, the common labeling information is printed in advance and a background color of an area where at least a plurality of labeling elements is printed is a print color that is printable by the printing device.

In this case, it is preferable that the labeling element is a segment and that the common labeling information is made up of a segment group.

In the print medium, it is preferable that the segment group is a 7-segment segment group.

In the print medium, it is preferable that the segment group is a 14-segment segment group.

According to these configurations, by selectively overprinting (painting over), in the print color, the labeling element of the pre-printed common labeling information, it is possible to form (display) the labeling information (individual labeling information). In this case, since the color of the labeling information does not depend on the print color, the color of the labeling information can be changed without changing the print color of the printing device. Also, the color of the labeling information can be changed with a simple configuration.

In this case, it is preferable that the print medium further has an area for printing the labeling information in the print color by the printing device, in addition to an area where the common labeling information is printed.

According to this configuration, the labeling information in the print color of the printing device and the labeling information in a different color from the print color (individual labeling information) can be formed on a single print medium.

It is also preferable that the print medium further has a positioning mark for relative position in a feeding direction with respect to the printing device.

In this case, it is preferable that the positioning mark is formed in the form of a hole.

According to these configurations, since the positioning mark (sign for positioning) is provided, the labeling element can be overprinted accurately.

Another aspect of the invention is directed to a printing device using the print medium described above as a print target and including: a medium setting unit in which the print medium is set; a print unit which carries out printing on the print medium that is set; and a control unit which controls the print unit. The control unit causes the labeling element of the common labeling information on the print medium to be selectively overprinted in the print color and thus forms the individual labeling information.

Still another aspect of the invention is directed to a printing method for a printing device using the print medium described above as a print target and including: causing the printing device to selectively overprint, in the print color, the labeling element of the common labeling information on the print medium and thus form the individual labeling information.

According to these configurations, the color of the labeling information formed on the print medium can be changed without changing the ink ribbon or ink installed in the printing device. That is, color labeling information can be formed with the configuration of a monochrome printing device.

It is preferable that the printing device further includes a detection unit which detects the positioning mark, and that the control unit causes the overprinting to be carried out on the basis of a result of detection by the detection unit.

According to this configuration, the labeling element can be overprinted accurately by the print unit.

It is preferable that the printing device further includes a leading end detection unit which detects a leading end position of the print medium, and that the control unit causes the overprinting to be carried out, using the detected leading end position as a positioning reference for relative positioning in a feeding direction with respect to the printing device.

According to this configuration, the labeling element can be overprinted accurately by the print unit, from any starting position.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, a print medium, a printing device, and a printing method for a printing device according to an embodiment of the invention will be described with reference to the accompanying drawings. In this embodiment, a special print tape to which the print medium according to the invention is applied, and a label preparation device (printing device) using this special print tape are described as an example. First, the label preparation device will be described with reference to FIGS. 1 and 2. This label preparation device performs print processing on the print tape, cuts off the printed part of the print tape, and thus prepares a label on which labeling information is formed. Particularly, assuming the preparation of a label to be pasted on an electric wire or the like, this label preparation device uses the special print tape as a print tape and thus prepares a label on which color is changed from one piece of labeling information to another.

Figure 1:
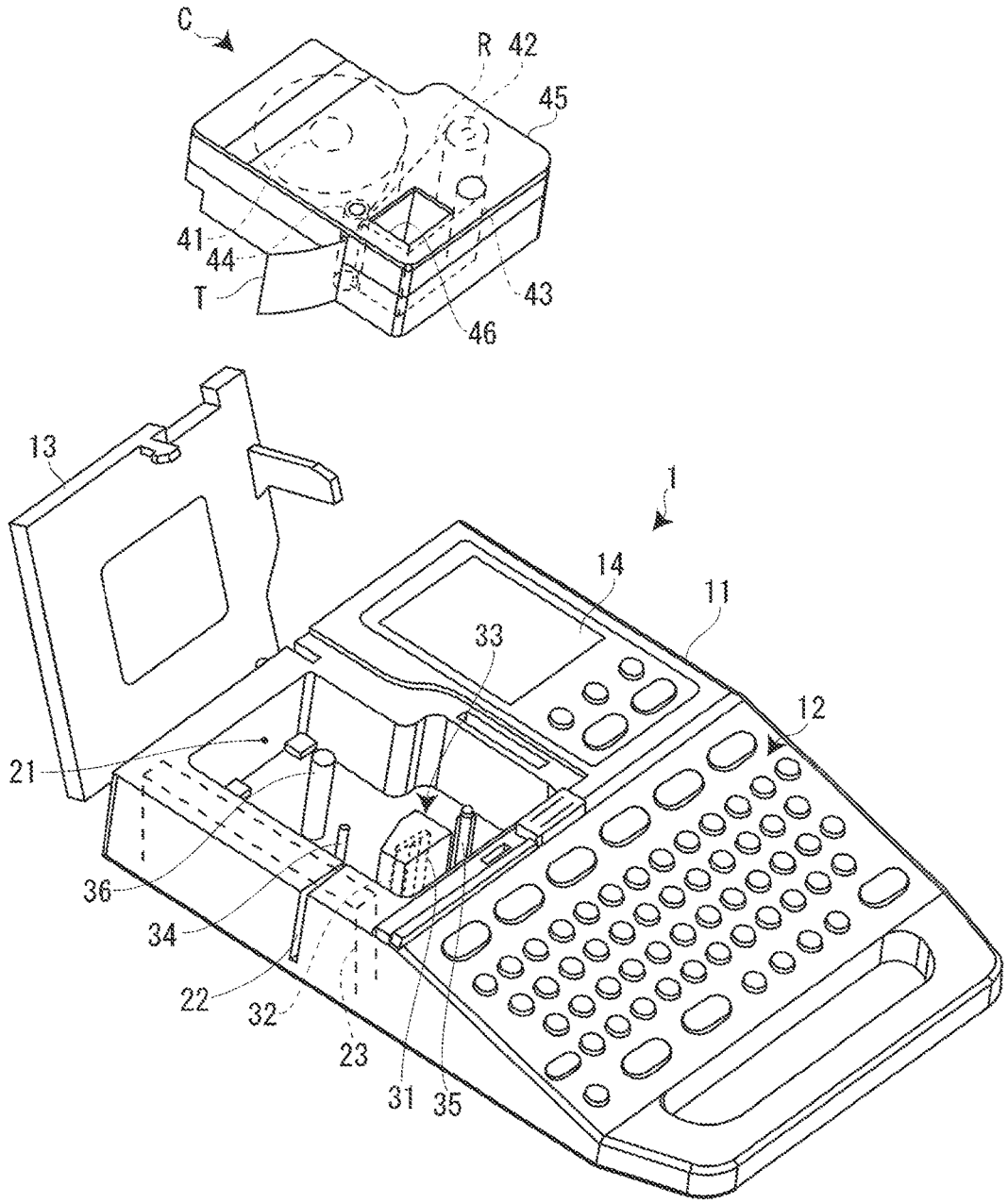
FIG. 1 is an outer perspective view showing a label preparation device according to an embodiment.

As shown in FIG. 1, a label preparation device 1 has an outer shell formed by a device case 11. A keyboard 12 is arranged broadly on the top surface of a front half part of the device case 11. On the top surface of a rear half part of the device case 11, an open/close cover 13 is arranged in a left part and a display 14 is arranged in a right part. FIG. 1 shows the state where the open/close cover 13 is opened.

Inside the open/close cover 13, a cartridge loading section 21 for loading a tape cartridge C is formed in the form of a recess. The tape cartridge C is loaded removably in the cartridge loading section 21 in the state where the open/close cover 13 is opened.

In a left lateral part of the device case 11, a tape discharge port 22 connecting the cartridge loading section 21 to outside is formed. In this tape discharge port 22, a tape cutter 23 for cutting a print tape T is present.

Meanwhile, in the cartridge loading section 21, a head unit 33 including a thermal-type print head 32 arranged inside a head cover 31, a platen drive shaft 34 standing opposite the print head 32, a take-up drive shaft 35 which reels in an ink ribbon R, described later, and a positioning protrusion 36 for a tape reel 41, described later, are provided. This cartridge loading section 21 forms a "medium setting unit" in which the print tape T and the ink ribbon R are set. Below the cartridge loading section 21, a tape feeding motor 37 (see FIG. 2) which rotates the platen drive shaft 34 and the take-up drive shaft 35, as a tape carrying mechanism, is provided inside. Also, a circuit board forming a control unit 51 (see FIG. 2) which controls the tape feeding motor 37 and the like is installed inside the device case 11.

The tape cartridge C has the tape reel 41 on which the print tape T is wound, a ribbon reel 42 on which the ink ribbon R is wound, a ribbon take-up reel 43 which reels in the ink ribbon R, a platen roller 44 standing opposite the print head 32, and a cartridge case 45 accommodating these elements. In the cartridge case 45, a head opening 46 in which the head cover 31 covering the head unit 33 is inserted is formed, vertically penetrating the cartridge case 45. The color of the ink ribbon R wound on the ribbon reel 42 is the color (print color) that is printable by the label preparation device 1 in which the tape cartridge C is loaded. In this embodiment, the case where the print color is black is described as an example. Although not described in detail, the ground color of a special print area 82 and the color of a segment 84 on a special print tape Ts are set according to the print color (color of the ink ribbon R).

As the tape cartridge C is loaded in the cartridge loading section 21, the head cover 31 is inserted in the head opening 46, and the positioning protrusion 36 is inserted in the center hole of the tape reel 41. The platen drive shaft 34 is inserted in the center hole of the platen roller 44, and the take-up drive shaft 35 is inserted in the center hole of the ribbon take-up reel 43. With the rotational driving of the platen drive shaft 34 and the take-up drive shaft 35, the print tape T is reeled off from the tape reel 41, and the ink ribbon R is reeled off from the ribbon reel 42. Then, the print tape T and the ink ribbon R, thus reeled off, overlap with each other at the position of the head opening 46 and travel together. Subsequently, the print tape T is sent out of the cartridge case 45, and the ink ribbon R is reeled in on the ribbon take-up reel 43. In the part where the print tape T and the ink ribbon R travel together, the platen roller 44 and the print head 32 are present in the way of sandwiching the print tape R and the ink ribbon R. Thus, so-called print-and-feed is carried out.

Figure 2:
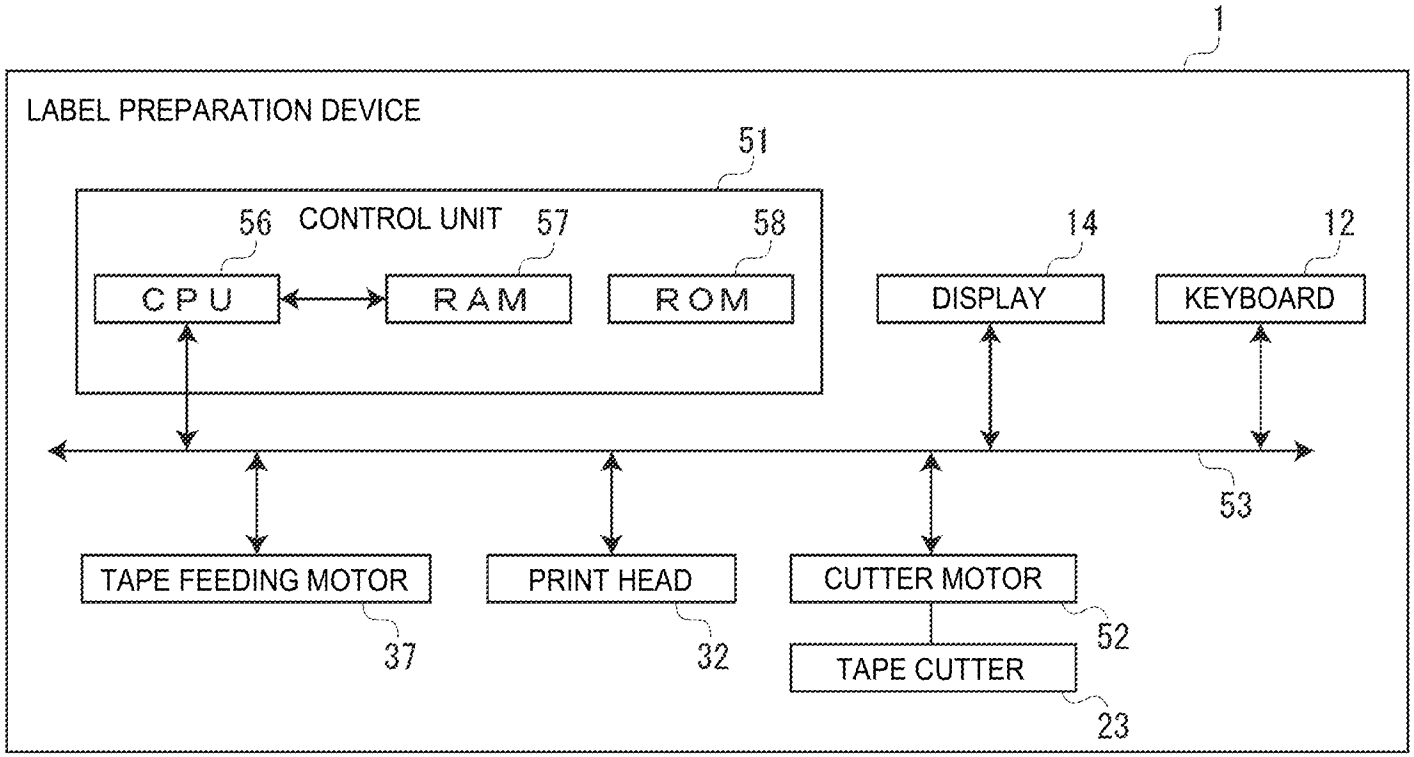
FIG. 2 is a block diagram showing the control configuration of the label preparation device.

Next, the control configuration of the label preparation device 1 will be described with reference to FIG. 2. The label preparation device 1 has the control unit 51, the display 14, the keyboard 12, the print head 32, the tape feeding motor 37, a cutter motor 52, and the tape cutter 23. These elements are connected together via a bus 53.

The control unit 51 has a CPU 56 (central processing unit), a RAM 57 (random access memory), and a ROM 58 (read only memory). The CPU 56 performs various kinds of arithmetic processing. The RAM 57 is used as a work area for the CPU 56 to perform various kinds of arithmetic processing. The ROM 58 stores a control program and control data used for the CPU 56 to perform arithmetic processing.

The display 14 functions as a display unit for displaying an editing result and print layout. The keyboard 12 functions as an input unit for the user to input information.

The print head 32 and the tape feeding motor 37 function as a print unit which performs printing on the print tape T while carrying the print tape T. The cutter motor 52 is connected with the tape cutter 23 and functions together as a cutting unit.

In the label preparation operation by the label preparation device 1, the control unit 51 generates print data D according to an input content provided via the keyboard 12, and controls the print unit (print head 32 and tape feeding motor 37) to print the generated print data D on the print tape T. Then, the control unit 51 controls the cutter motor 52 to cut the printed part of the print tape T, and thus prepares a label L.

Figure 3A:
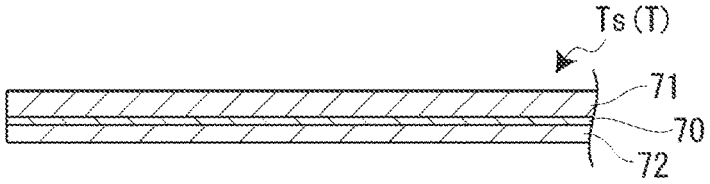
FIG. 3A is a cross-sectional view showing a special print tape.
Figure 3B:
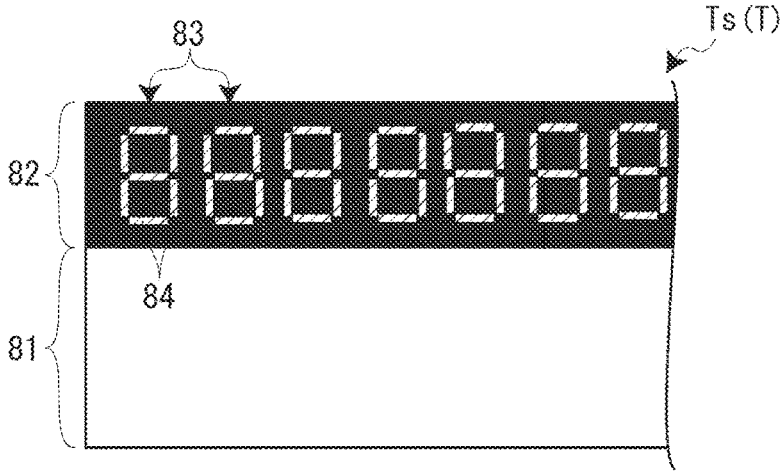
FIG. 3B is a plan view showing the special print tape.
Figure 3C:
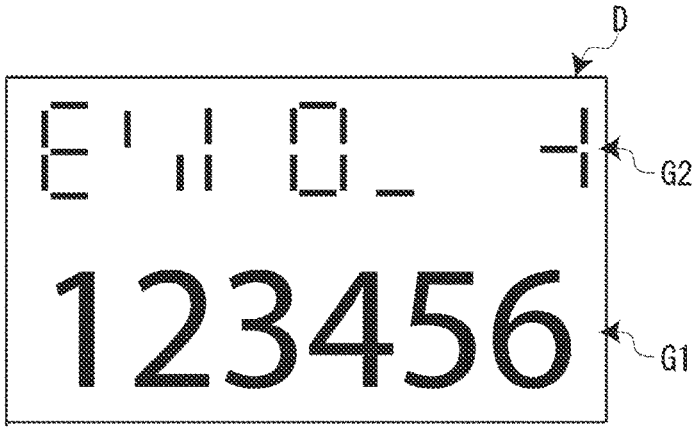
FIG. 3C shows print data to the special print tape.

Now, a special print tape Ts used in the label preparation device 1 will be described with reference to FIGS. 3A to 3D. As shown in FIG. 3A, the special print tape Ts is made up of a recording tape 71 with an adhesive layer 70 formed on the back side thereof, and a release tape 72 pasted to the recording tape 71 via the adhesive layer 70. As shown in FIG. 3B, on the surface of the recording tape 71, a normal print area 81 and a special print area 82 are formed next to each other in the direction of tape width. The normal print area 81 is a print area where the ground color (background color) is white. Therefore, in the normal print area 81, a print image G1 is printed by the label preparation device 1 and labeling information (first labeling information 91) in the print color of the label preparation device 1 (black) is thus formed.

Meanwhile, in the special print area 82, the ground color (background color) is substantially the same as the print color of the label preparation device 1. In the special print area 82, a plurality of 7-segment segment groups 83 is pre-printed next to each other in the direction of tape length. That is, in the special print area 82, the plurality of segment groups 83 is printed in advance, arranged in a row over the entire area in the direction of tape length. Each segment group 83 is made up of 7 segments (labeling elements) 84 arranged in the shape of "8". All the segments 84 are formed in a different color (for example, yellow) from the print color of the label preparation device 1. The color of the segments 84 is to be the color of labeling information (second labeling information 92) formed in the special print area 82. Also, in this embodiment, one or more segment groups 83 that fall within the tape length of the label L to be prepared form "common labeling information".

In the label preparation operation in the case where the special print tape Ts is used, normal printing is performed in the normal print area 81, and printing to selectively paint over a segment or segments 84 is performed in the special print area 82. That is, the control unit 51 generates print data D including a print image G1 to be printed in the normal print area 81, and a print image G2 to be printed in the special print area 82 and to selectively overprint a segment or segments 84 of the segment group 83 in the special print area 82 (see FIG. 3C). Then, the control unit 51 controls the print unit (print head 32 and tape feeding motor 37) to print this print data D on the special print tape Ts.

Figure 3D:
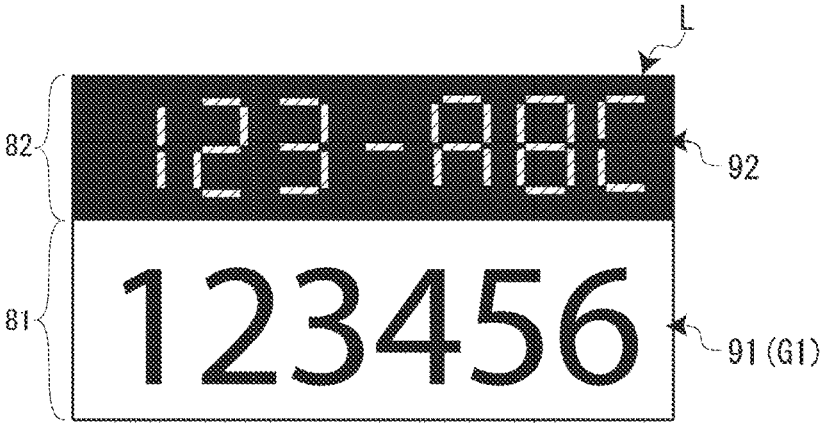
FIG. 3D shows a preparation example of a label based on the special print tape.

As a result, in the normal print area 81, the print image G1 is formed and the first labeling information 91 ("123456") formed in the print color (black) is thus formed, as shown in FIG. 3D. That is, the first labeling information 91 made up of the print image G1 is formed by printing.

Meanwhile, in the special print area 82, a segment or segments 84 are painted over in the print color by overprinting and thus assimilated into the ground color of the special print area 82 (color assimilation). Thus, in one or more segment groups 83, the segment(s) 84 in question turn into a non-display state (invisible state). As the segment(s) 84 in question turn into the non-display state, a segment pattern made up of the other segments 84 that are displayed is formed, and the second labeling information (individual labeling information) 92 ("123-ABC") in the color (yellow) of the segments 84 is formed. That is, by overprinting, the second labeling information 92 made up of a segment pattern in which one or more segments 84 of each segment group 83 are selectively displayed is formed.

After the respective pieces of labeling information 91, 92 are formed by print processing, the cutter motor 52 is controlled to perform cutting processing on the special print tape Ts. Thus, the label L on which color is changed between the respective pieces of labeling information 91 and 92 is prepared.

According to the above configuration, since the color of the second labeling information 92 does not depend on the print color of the label preparation device 1, the color of the second labeling information 92 can be changed without changing the print color of the label preparation device 1. Also, the color of the second labeling information 92 can be changed with a simple configuration. More specifically, color labeling information can be formed using the configuration of a monochrome printing device. For example, in the case of preparing a label L to be pasted on an electric wire, the color of labeling information can be changed from one type of electric wire to another. Also, in the case of preparing a label L on which a plurality of pieces of labeling information is formed, as the label L to be pasted on an electric wire, the color can be changed from one piece of labeling information formed thereon to another.

Since the special print tape Ts has the normal print area 81 and the special print area 82, the labeling information (first labeling information 91) in the print color of the label preparation device 1 and the labeling information (second labeling information 92) in a different color from the print color can be printed on the single print tape T.

In the embodiment, the print image G2 that overprints the segments 84 has the respective overprint images (image lines) of the same shape as the respective segments 84 to be overprinted. However, it is preferable that the overprint images on the segments 84 are slightly larger than the segments 84. According to this configuration, the segments 84 can be painted over even if the print position of the overprint images is slightly shifted.

Figure 4A:
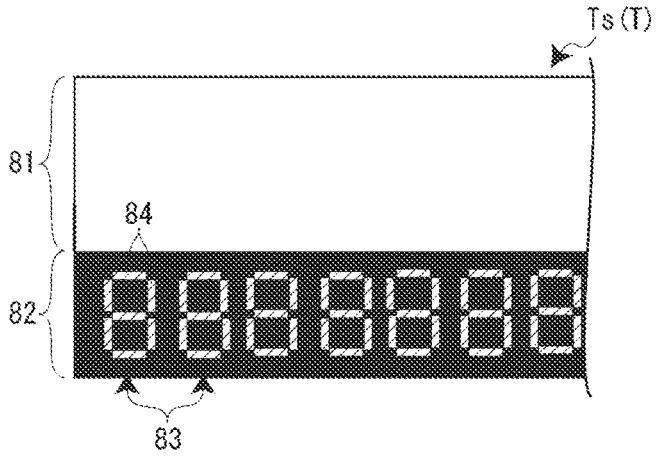
FIG. 4A is a plan view showing a special print tape according to a first modification.
Figure 4B:
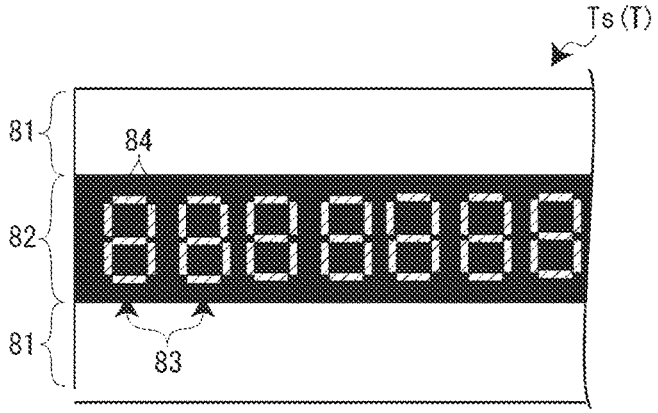
FIG. 4B is a plan view showing a special print tape according to a second modification.
Figure 4C:
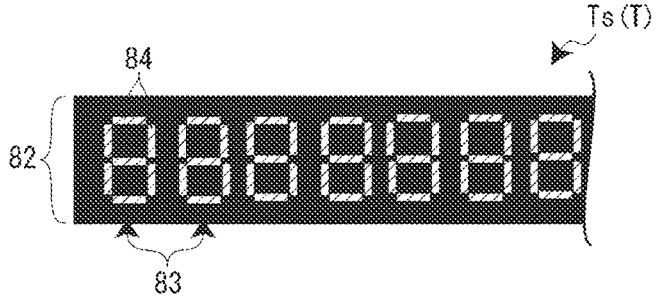
FIG. 4C is a plan view showing a special print tape according to a third modification.

In the embodiment, the special print tape Ts is configured in such a way that the normal print area 81 is arranged on the right-hand side in the tape feeding direction (bottom side in FIGS. 3B and 3D) and that the special print area 82 is arranged on the left-hand side in the tape feeding direction (top side in FIGS. 3B and 3D). However, the positions of arrangement of the normal print area 81 and the special print area 82 are not limited to this example. For example, as shown in FIG. 4A, the normal print area 81 may be arranged on the left-hand side in the tape feeding direction and the special print area 82 may be arranged on the right-hand side in the tape feeding direction. Also, as shown in FIG. 4B, the special print area 82 may be arranged in the center in the direction of tape width and the normal print area 81 may be arranged on both right and left-hand sides thereof. Moreover, as shown in FIG. 4C, a special print tape Ts having only the special print area 82 may be used.

Figure 4D:
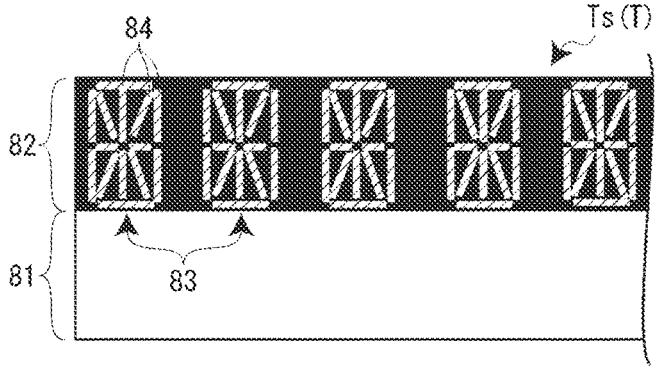
FIG. 4D is a plan view showing a special print tape according to a fourth modification.

In the embodiment, the 7-segment segment group 83 is used. However, this is not limiting. For example, a 14-segment segment 83 may be used, as shown in FIG. 4D. Also, an 8-segment segment group 83 made up of the 7-segment segment group 83 plus a dot segment representing a decimal point may be used. Also, a 16-segment segment group 83 made up of the 14-segment segment group 83 with the top and bottom lateral segments divided into two each may be used.

Figure 5A:
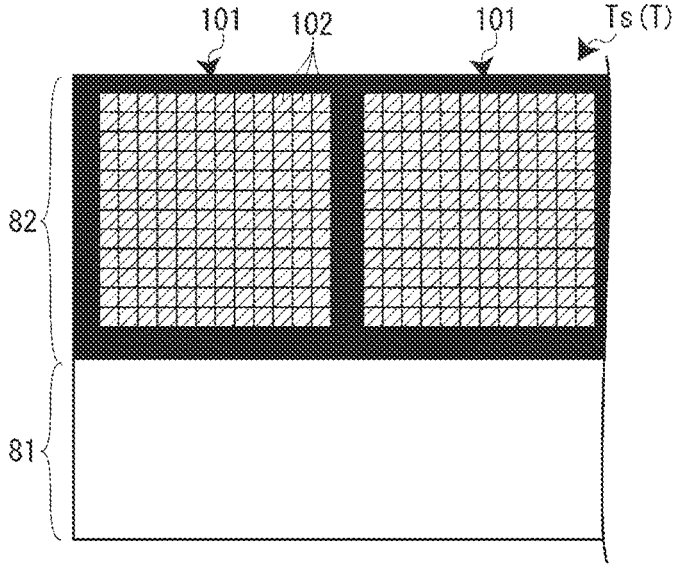
FIG. 5A is a plan view showing a special print tape according to a fifth modification.
Figure 5B:
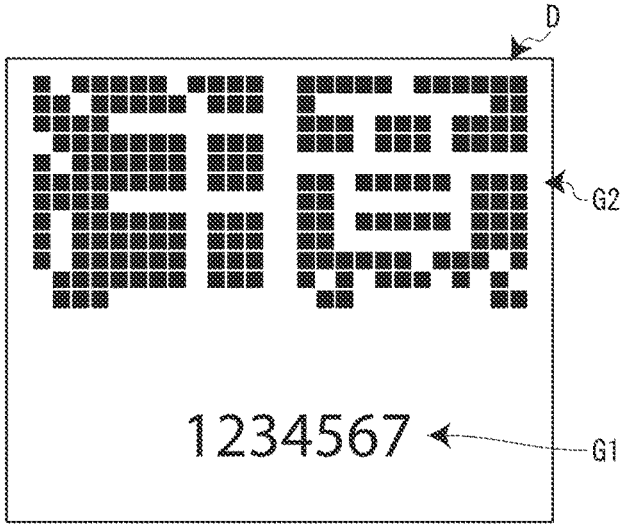
FIG. 5B shows print data to the special print tape according to the fifth modification.
Figure 5C:
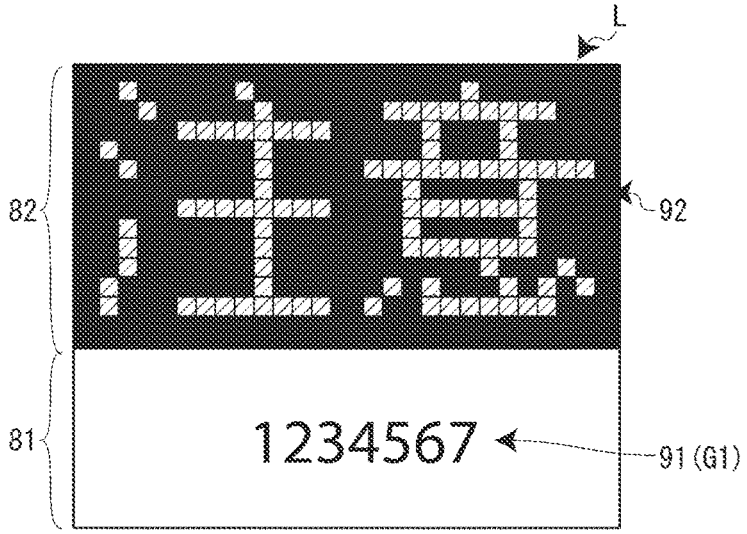
FIG. 5C is a plan view showing a preparation example of a label based on the special print tape according to the fifth modification.

In the embodiment, the segment group 83 made up of the plurality of segments 84 is used. However, a dot group 101 made up of a plurality of dots 102 may be used, as shown in FIG. 5A. In this case, in the special print area 82 on the special print tape Ts, a plurality of dot groups (common labeling information) 101 in which the plurality of dots (labeling elements) 102 is arranged, for example, in the form of a matrix, is pre-printed next to each other in the direction of tape length, as shown in FIG. 5A. Also, as shown in FIG. 5B, print data D having a print image G2 to be printed in the special print area 82 and to overprint a dot or dots 102 in the special print area 82, in addition to a print image G1 to be printed in the normal print area 81, is generated. Then, as a result of printing this print data D, as shown in FIG. 5C, the first labeling information 91 made up of the print image G1 is formed in the normal print area 81, whereas in the special print area 82, the dot(s) 102 are painted over in the print color by overprinting, and a dot pattern made up of the other dots 102 that are displayed is formed. That is, the second labeling information 92 made up of the dot pattern is formed by overprinting.

In the embodiment, the special print tape Ts may further include a positioning mark for relative positioning in the feeding direction with respect to the label preparation device 1. In this case, the label preparation device 1 further includes a mark detection unit (detection unit) which detects the positioning mark. The control unit 51 causes the printing of the print data D including the overprinting to be carried out on the basis of the result of the detection by the mark detection unit. According to this configuration, overprinting of labeling elements (segments 84 or dots 102) can be carried out accurately. The positioning mark may be formed on the front side of the special print tape Ts (surface of the recording tape 71) or may be formed on the back side of the special print tape Ts (surface of the release tape 72). The positioning mark may be formed in the form of a hole.

In the embodiment, the label preparation device 1 may further include a leading end detection unit which detects the leading end position of the special print tape Ts, and the control unit 51 may cause the printing of the print data D including the overprinting, using the leading end position detected by the leading end detection unit as a positioning reference for relative positioning in the feeding direction with respect to the label preparation device 1.

In the embodiment, the elongate tape having the recording tape 71 extending over the entire area in the direction of tape length is used as the special print tape Ts. However, as the special print tape Ts, a die cut tape on which the recording tape 71 is divided in the direction of tape length may be used. In this case, an end part (forward end and/or rear end) in the direction of tape length, of the divided recording tape 71, may be used as the positioning mark.

Moreover, a paper tape having only the recording tape 71 may be used as the special print tape Ts.

What is claimed is:

1. A print medium comprising:

a print area where individual labeling information made up of one or more labeling elements included in a plurality of labeling elements may be formed by a printing device, the print area comprising:

a background that has a background color that is a same color as a print color that is printable by the printing device, and common labeling information made up of the plurality of labeling elements, and a positioning mark for positioning the print medium in a feeding direction with respect to the printing device, wherein the plurality of labeling elements of the common labeling information are a color that is different from the background color.

2. The print medium according to claim 1, wherein each labeling element included in the plurality of labeling elements is a segment, and the common labeling information is made up of a segment group.

3. The print medium according to claim 2, wherein the segment group is a 7-segment segment group.

4. The print medium according to claim 2, wherein the segment group is a 14-segment segment group.

5. The print medium according to claim 1, further comprising:

a second print area for printing second labeling information in the print color by the printing device.

6. The print medium according to claim 1, wherein the positioning mark is formed in the form of a hole.

7. A printing device using the print medium according to claim 1 as a print target, the device comprising:

a medium setting unit in which the print medium is set;

a print unit which carries out printing on the print medium that is set; and a control unit which controls the print unit;

wherein the control unit causes the one or more labeling elements included in the plurality of labeling elements that make up the common labeling information on the print medium to be selectively overprinted in the print color to form the individual labeling information.

8. A printing device using the print medium according to claim 6 as a print target, the device comprising:

a medium setting unit in which the print medium is set;

a print unit which carries out printing on the print medium that is set; and a control unit which controls the print unit;

wherein the control unit causes the one or more labeling elements included in the plurality of labeling elements that make up the common labeling information on the print medium to be selectively overprinted in the print color to form the individual labeling information.

9. The printing device according to claim 7, further comprising:

a detection unit which detects the positioning mark, wherein the control unit causes the overprinting to be carried out based on when the positioning mark is detected by the detection unit.

10. The printing device according to claim 8, further comprising a detection unit which detects the positioning mark, wherein the control unit causes the overprinting to be carried out based on when the positioning mark is detected by the detection unit.

11. The printing device according to claim 7, further comprising a leading end detection unit which detects a leading end position of the print medium, wherein the control unit causes the overprinting to be carried out, using the detected leading end position as a positioning reference for positioning the print medium in a feeding direction with respect to the printing device.

12. The printing device according to claim 8, further comprising a leading end detection unit which detects a leading end position of the print medium, wherein the control unit causes the overprinting to be carried out, using the detected leading end position as a positioning reference for positioning the print medium in a feeding direction with respect to the printing device.

13. A printing method for a printing device using the print medium according to claim 1 as a print target, the method comprising:

causing the printing device to selectively overprint, in the print color, the one or more labeling elements included in the plurality of labeling elements that make up the common labeling information on the print medium to form the individual labeling information.

14. A printing method for a printing device using the print medium according to claim 2 as a print target, the method comprising:

causing the printing device to selectively overprint, in the print color, the one or more labeling elements included in the plurality of labeling elements that make up the common labeling information on the print medium to form the individual labeling information.

15. A printing method for a printing device using the print medium according to claim 3 as a print target, the method comprising:

causing the printing device to selectively overprint, in the print color, the one or more labeling elements included in the plurality of labeling elements that make up the common labeling information on the print medium to form the individual labeling information.

16. A printing method for a printing device using the print medium according to claim 4 as a print target, the method comprising:

causing the printing device to selectively overprint, in the print color, the one or more labeling elements included in the plurality of labeling elements that make up the common labeling information on the print medium to form the individual labeling information.

17. A printing method for a printing device using the print medium according to claim 5 as a print target, the method comprising:

causing the printing device to selectively overprint, in the print color, the one or more labeling elements included in the plurality of labeling elements that make up the common labeling information on the print medium to form the individual labeling information.

18. A printing method for a printing device using the print medium according to claim 6 as a print target, the method comprising:

causing the printing device to selectively overprint, in the print color, the one or more labeling elements included in the plurality of labeling elements that make up the common labeling information on the print medium to form the individual labeling information.

* * * * *